United States Patent [19]

Diggle, Jr. et al.

[11] Patent Number: 4,624,036

[45] Date of Patent: Nov. 25, 1986

[54] AUTOMATIC ORIENTATION GUIDE FOR TUBULAR KNITTED FABRIC

[75] Inventors: Edmund A. Diggle, Jr., Oradell, N.J.; Andrew P. Cecere, Valley Stream, N.Y.

[73] Assignee: Samcoe Holding Corporation, Woodside, N.Y.

[21] Appl. No.: 695,474

[22] Filed: Jan. 28, 1985

Related U.S. Application Data

[62] Division of Ser. No. 357,972, Mar. 15, 1982, Pat. No. 4,517,712.

[51] Int. Cl.[4] ..... D06C 5/00; D06H 3/12

[52] U.S. Cl. ..... 26/51.4; 26/74; 26/85

[58] Field of Search ..... 26/1, 51.3, 51.4, 51.5, 26/74, 82, 85, 80

[56] References Cited

U.S. PATENT DOCUMENTS

| | | | |
|---|---|---|---|
| 2,189,166 | 2/1940 | Cohn et al. | 26/85 |
| 2,467,281 | 4/1949 | Walter et al. . | |
| 2,503,705 | 4/1950 | Blumenbaum et al. | 26/51.3 UX |
| 2,652,615 | 9/1953 | Lasley | 26/80 |
| 2,737,700 | 3/1956 | Thompson | 26/1 X |
| 2,773,296 | 12/1956 | Cohn et al. | 26/80 |
| 3,472,048 | 10/1969 | Shaw et al. | 26/1 X |
| 3,776,077 | 12/1973 | Letsche | 26/82 |
| 4,173,812 | 11/1979 | Cecere | 26/84 |
| 4,192,045 | 3/1980 | Frezza . | |
| 4,262,397 | 4/1981 | Cecere | 26/84 |
| 4,305,185 | 12/1981 | Frezza . | |

FOREIGN PATENT DOCUMENTS

| | | | |
|---|---|---|---|
| 2015239 | 10/1971 | Fed. Rep. of Germany | 26/82 |
| 2398006 | 3/1979 | France | 26/51.3 |
| 1339494 | 12/1973 | United Kingdom | 26/1 |
| 553316 | 6/1977 | U.S.S.R. | 26/51.4 |

OTHER PUBLICATIONS

*International Textile Bulletin*—First Quarter—1/19-82—"Instrument for Automatic Piece Separation".

*Textile Asia*—TA 11417, p. 160-"Sensor-Slitter'-'—7/1981.

*Tube Opening Machine* TSM 8, Erhardt & Leimer K.G., 2-15, 13.000-4E73, D-8900, Augsburg 1, Postfach 101540, Leitershofer Strasse 80.

*EL Tube Opening System* EKS 25, Erhardt & Leimer K.G., 2-14 09.25.000-4E75, D-8900 Augsburg, Leitershofer Strasse 80, Postfach 101540.

*Primary Examiner*—Robert R. Mackey

*Attorney, Agent, or Firm*—Mandeville and Schweitzer

[57] ABSTRACT

The disclosure relates to the finish processing of tubular knitted fabric in the manner to effect accurate, uniform alignment of the sewn seam at the edge extremity of the fabric tube, as it is being finished and gathered in flat form. Stripe-matched tubular knitted fabric has been slit longitudinally, adjusted to convert stripes from spiral to circular form, and resewn along its entire length. An equipment and method is provided for finish processing of such fabric, wherein a novel arrangement is provided for rotationally manipulating a laterally distended fabric to maintain accurate, uniform edge alignment of the sewn seam.

13 Claims, 15 Drawing Figures

CLOTH
10
11
12
13
17
18
19
20
21
22
23
24
24a
25
26
27
28
29
31
32
41a
42
43
44
45
63
74
76
78
79
3
7

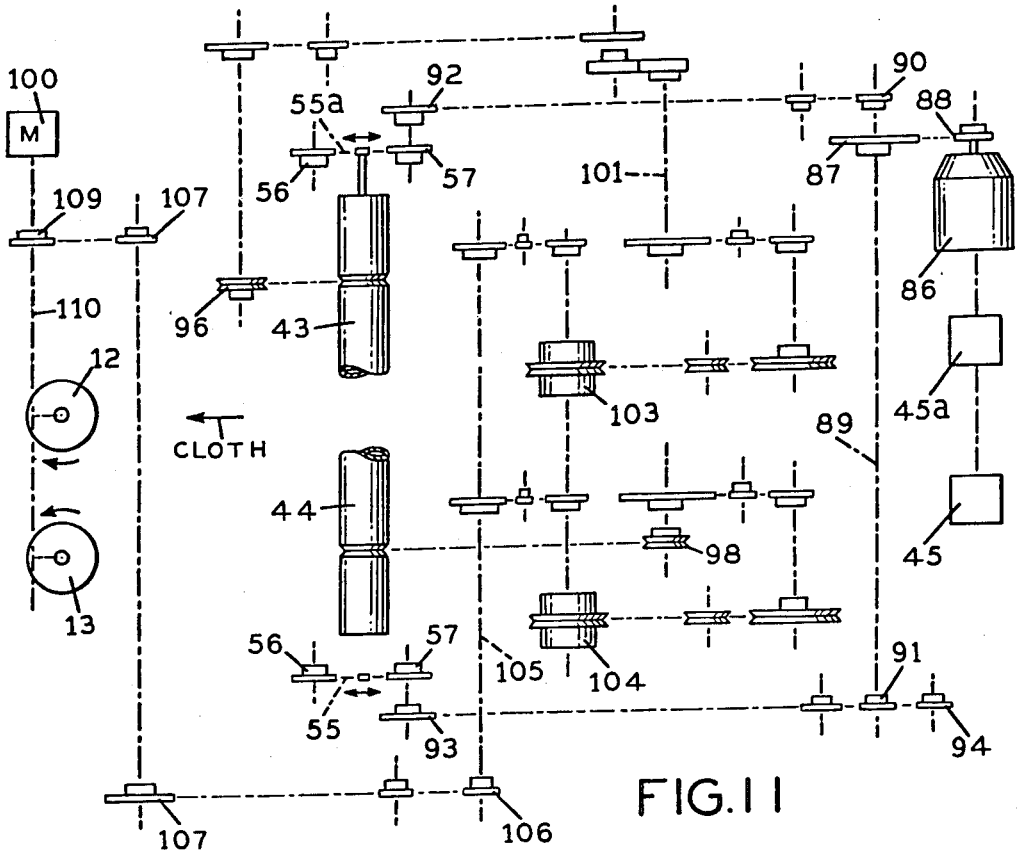
FIG. 11
FIG. 8
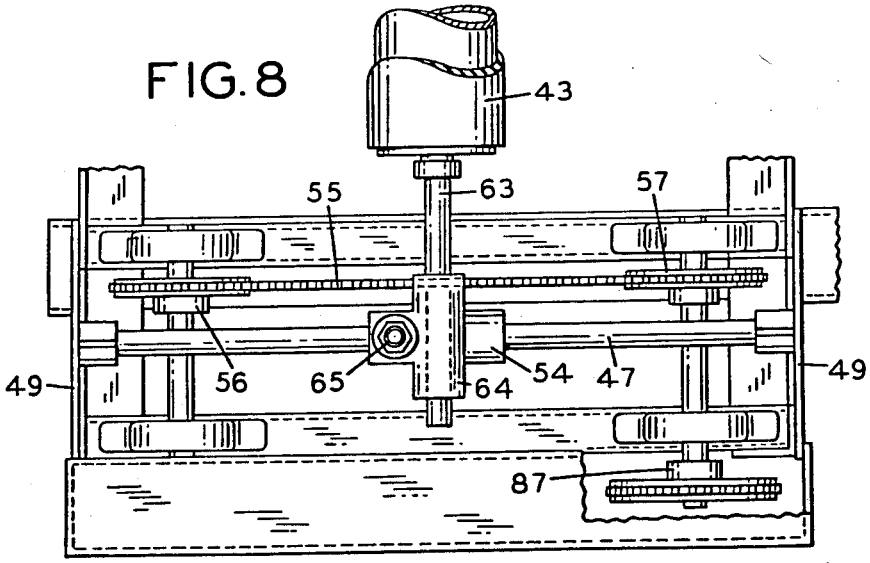

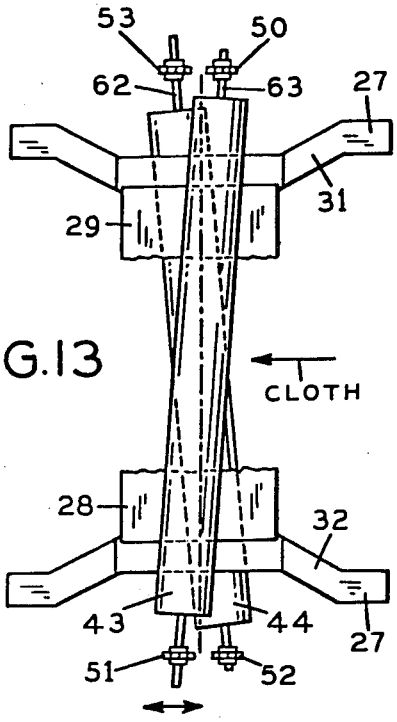
FIG.13
FIG.12
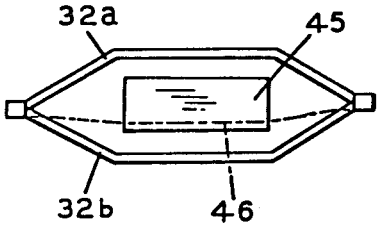
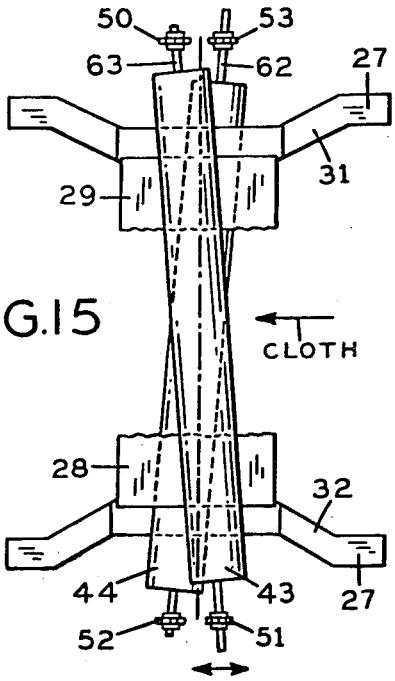
FIG.15
FIG.14
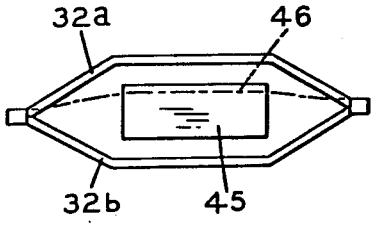

AUTOMATIC ORIENTATION GUIDE FOR TUBULAR KNITTED FABRIC

RELATED APPLICATIONS

This application is a divisional of my copending application Ser. No. 357,972, filed Mar. 15, 1982 U.S. Pat. No. 4,517,712, granted May 21, 1985.

BACKGROUND AND SUMMARY OF THE INVENTION

In the production of tubular knitted fabric, it is conventional for the fabric to be knitted in circular form, in semi-continuous lengths. The knitting operation proceeds in the manner of a continuous spiral, continuously adding to the trailing edge of the emerging tube of fabric. In a typical circular knitting machine, a number of knitting stages are provided around a circular platform such that, in each cycle of knitting, a plurality of courses are knitted into the continuously constructed fabric tube. The spiral structure of the fabric is thus readily evident in a typical production fabric, where a number of courses are knitted in each cycle.

In the manufacture of striped circular knitted fabrics, such as for use in the manufacture of polo shirts and the like, the spiral orientation of the stripes is very noticeable in the knitted tube. Typically, therefore, in the production of outer wear garments, particularly of striped fabric, it is conventional to process the knitted circular fabric by slitting it lengthwise along its full length, laterally displacing the cut edges a full stripe width, one with respect to the other, and sewing the seam closed with the stripes aligned in displaced positions. This results in stripes which run circularly around the fabric tube, at right angles to its axis, rather than the original spirally configured stripes. Typical equipment for performing this operation is shown in the Walter et al. U.S. Pat. No. 2,467,281. The operation performed is normally referred to as stripe matching.

In the typical finish processing of tubular knitted fabric, the tubular fabric material is flattened and spread laterally to a predetermined, uniform width. It is then geometrically stabilized by being steamed while on the spreader and then immediately passed through an opposed pair of calender rolls and thence to an appropriate gathering station, where the fabric is gathered in either roll or folded form. In the finishing operations, it is highly desirable to orient the fabric so that the sewn seam is located exactly at the edge extremity of the fabric, as the fabric passes over the spreader and through the steaming and calendering stations. Heretofore, this has been achieved only by the continuous attention of a vigilant machine operator, feeding the fabric onto the entry end of the fabric spreader and carefully aligning and twisting the continuously advancing fabric tube in order to position the seam at or near the edge extremity. Under the best of circumstances, however, it has been difficult to achieve effective results with this manual practice as previously employed in the industry.

In accordance with the present invention, a finishing apparatus is provided which incorporates a novel and advantageous mechanism for effecting precise rotational orientation of the fabric tube relative to the spreader frame, such that proper and uniform orientation of the sewn seam at or near the precise edge extremity of the fabric tube is readily achieved. More importantly, the apparatus of the invention accommodates the automatic sensing of the orientation of the fabric seam and manipulation of the fabric, as necessary, to maintain an accurate alignment of the seam in the desired position.

Pursuant to a specific aspect of the invention, the finishing equipment is provided with a modified form of spreader frame, including a section arranged for cooperation with upper and lower controllable orienting rollers. The orienting rollers desirably contact the fabric substantially across its width, and are normally disposed at right angles to the axis of movement of the fabric, so as to have a neutral effect on the orientation. When the fabric tube requires orientation in one direction or the other, the orienting rolls are shifted angularly, so that a rotational component is imparted to the advancing fabric tube, in a direction tending to return the misaligned seam to its desired position at the edge extremity.

In the simplest form of the invention, manipulation of the orienting rolls may be accomplished manually. While this requires the attention of an operator, the operator demands are much less severe than where it is required to continuously feed and orient the fabric entirely by hand.

More desirably, however, the apparatus of the invention is equipped to provide for automatic sensing of the seam location and automatic adjustment of the orienting rolls to compensate for any departure from the desired position. To this end, a stripe matching operation, which precedes the finishing, may be designed to include the step of laying in a fine metallic yarn along the seam. The seam could, in fact, be actually sewn with the metallic yarn. However, it is relatively more expensive than conventional yarns and serves its purpose just as well, and at less expense, as a laid-in component. The finishing frame of the new apparatus is designed to accommodate the presence of a sensing device, which is responsive to the position of the metallic yarn, which, of course, is the position of the seam itself. Upon sensing of a displacement of the seam from its normal, edge extremity position, a mechanism is activated to adjust the orienting rolls proportionately, to impart a correcting rotational component to the advancing fabric tube. The mechanism and process of the invention enable a sensitive, yet stable control to be exercised over the fabric, so that the edge seam is aligned with a great deal of precision and uniformity in the finished product, enabling a higher quality product to be achieved with a reduced labor expense.

For a more complete understanding of the above and other features and advantages of the invention, references should be made to the following detailed description of a preferred embodiment, and to the accompanying drawings.

DESCRIPTION OF THE DRAWINGS

FIG. 8 is a fragmentary top plan view of the mechanism of FIG. 7.

FIG. 11 is a simplified, schematic representation of the drive system incorporated in the illustrated embodiment of the invention.

FIGS. 12 and 13 are simplified schematic representations illustrating respectively a side view of the sensor element in conjunction with a downwardly displaced seam, and a top plan view illustrating the responsive adjustment of the orienting rollers in order to correct for such displacement.

FIGS. 14 and 15 are corresponding schematic illustrations illustrating upward displacement of the fabric seam and corresponding compensating adjustment of the orienting rollers responsive thereto.

DESCRIPTION OF A PREFERRED EMBODIMENT

Figure 1:
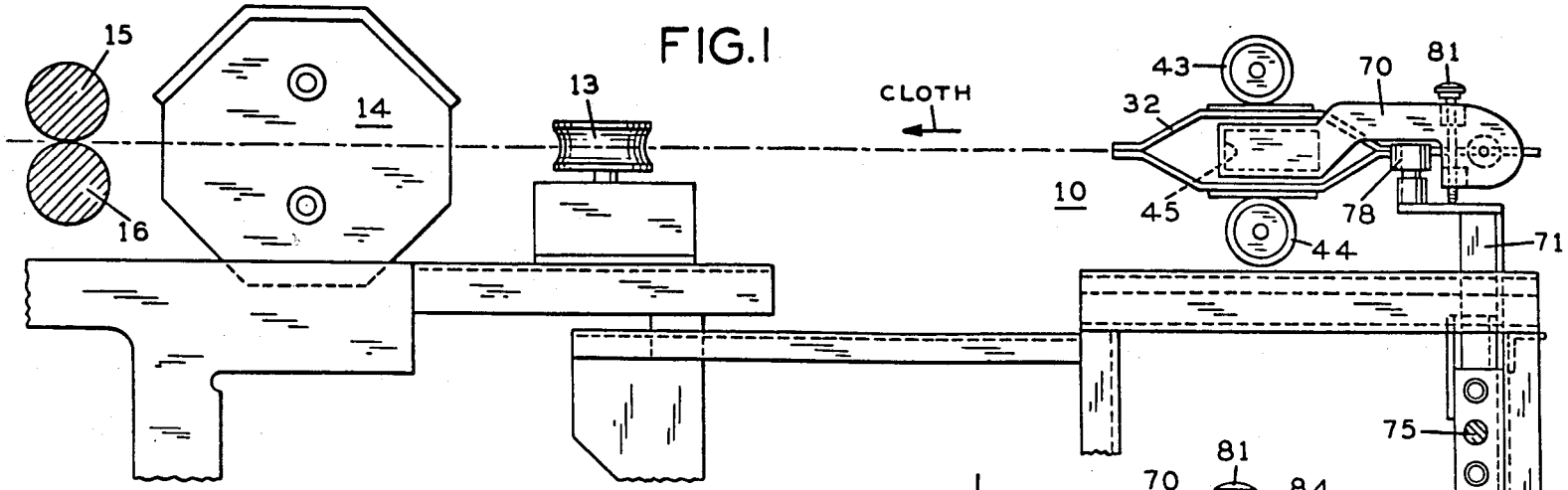
FIG. 1 is a simplified elevational representation of a finishing apparatus for tubular knitted fabric incorporating features of the invention.
Figure 2:
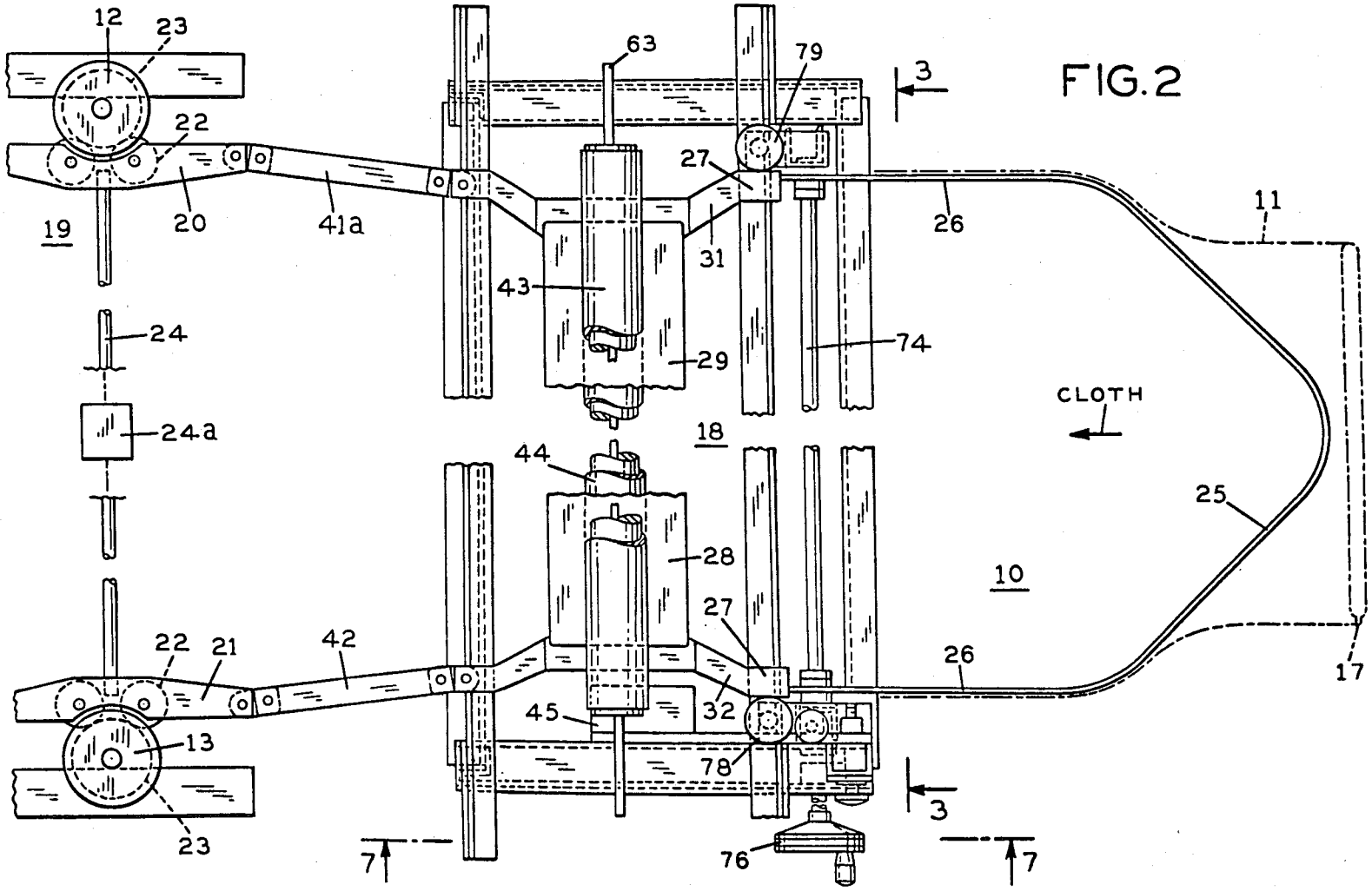
FIG. 2 is a top plan view of the finishing apparatus of the invention, illustrating particularly details of the modified spreader frame and the sensor mounting means.

Referring now to the drawings, and initially to FIGS. 1 and 2 thereof, the reference numeral 10 designates generally a spreader section of a fabric finishing apparatus, which receives tubular knitted fabric 11 from a supply (not shown). The spreader distends the fabric laterally, to flat form and to a predetermined width. The spreader 10 is positioned and supported by opposed edge drive rolls 12, 13, which engage the fabric tube at its edges and cause the fabric to be drawn over the spreader and to be advanced through the finishing line.

Downstream of the edge drive rolls 12, 13, the spreader section 10 is straddled by a steam box 14, of known design, which serves to discharge steam upon the distended fabric tube, from above and below the plane of the advancing fabric. Downstream of the steam box 14 is a pair of calender rolls 15, 16, which typically are heated and subject the fabric to heat and rolling pressure as it is discharged from the end of the spreader section 10. In this respect, the spreader section 10 typically is positioned such that its discharge end extremity is located as close as practicable to the pressure nip formed by the calender rolls 15, 16. The calender rolls 15, 16 serve to "iron" the spread and steamed fabric, and stabilize its geometry.

Downstream of the calender rolls, there is typically provided a gathering facility (not shown) for the finished fabric. This may be in the form of a roll-up device or a folding platform, for example.

In the finishing of tubular knitted fabric of striped construction, for example, it is conventional practice to perform a so-called stripe matching operation, as heretofore mentioned, in which the fabric tube is slit longitudinally, the slit edges shifted, one relative to the other, and then resewn, with the visible stripes now in a circular configuration, rather than a spiral configuration. One advantageous form of equipment for this purpose is illustrated in the Walter et al. U.S. Pat. No. 2,467,281, the disclosure of which is incorporated herein by reference. In general, the tubular knitted fabric 11 supplied to the apparatus of the invention will have previously been stripe matched and will have a sewn seam 17 extending throughout its full length. In the finishing operation, it is important that the sewn seam 17 be located rather accurately at the edge extremity of the flat, distended fabric tube, at the moment when the fabric is passed through the calender rolls 15, 16 and subjected to heat and rolling pressure. To this end, past practices have required the continuous presence of a rather alert machine operator, making sure that the sewn seam 17 is properly aligned with the edge of the spreader frame, as the fabric advances on to the frame from the supply source. With the equipment of the present invention, this task is performed entirely automatically, if desired. In cases where automatic orientation of the fabric is either not possible because of the nature of the fabric supplied, or not desirable, the equipment can be used in a manual mode with far greater effectiveness than with conventional equipment.

In accordance with the invention, the spreader frame 10 desirably is constructed to have two stages, an orienting stage, generally designated by the numeral 18, and a finishing section, located downstream of the orienting section, and generally designated by the numeral 19. To advantage, the two sections are width-adjustable, one with respect to the other. The downstream or finishing section of the spreader can be of a more or less known design, having frame sections 20, 21 mounting opposed pairs of rollers 22 which are received in concave grooves 23 in the edge drive rolls 12, 13. The frame sections 20, 21 are held in adjustably spaced relation, as by means of an adjustable spreader bar 24 provided with means such as a gas spring spreader 24*a*. An example of the latter is shown in the Frezza U.S. Pat. No. 4,192,045, granted Mar. 11, 1980, the disclosure of which is incorporated herein by reference. The frame is positioned between the edge drive rolls 12, 13, and the edge drive rollers are then adjusted to the desired spacing, contacting the frame rolls 22. The geometric relationship of the edge drive rolls 12, 13, and the frame rolls 22 is such that the spreader frame is supported against both vertical and longitudinal displacement by the contacting rolls. When tubular fabric is applied over the spreader and is moving along the frame, the fabric wall, at the edge extremities, is gripped between the edge drive rolls 12, 13, and the frame rolls 22, and is thus caused to be advanced in a forward direction.

Downstream of the edge drive rolls, the spreader frame may be provided with fabric engaging belts, which serve to convey the fabric by its edges substantially up to the calender rolls 15, 16.

The orienting or upstream section of the spreader frame 10 includes a wire-like entry section 25, which is tapered and rounded at its upstream end to facilitate reception of a fabric tube of relatively narrow dimensions. The entry section 25 is also provided with side rail sections 26, which are rigidly connected at their forward extremities to arms 27 of a fabric orienting platform 28. As will be further described, the platform 28 is width-adjustable, and the wire-like entry section 25 is sufficiently flexible to simply expand or contract as necessary to accommodate width adjustment of the platform.

Figure 4:
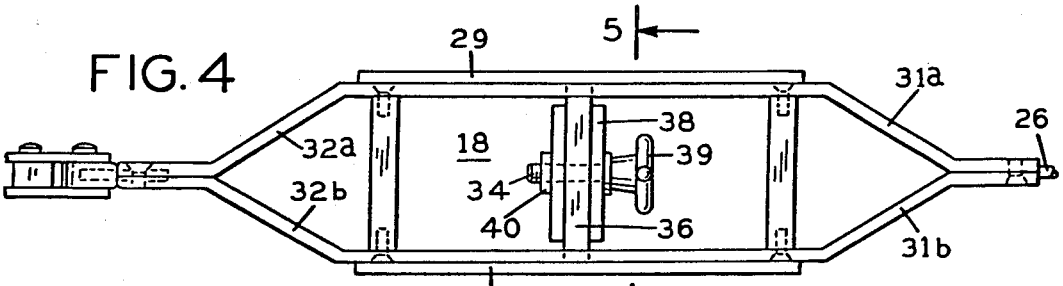
FIG. 4 is an enlarged, fragmentary elevational view showing a section of spreader frame designed and adapted especially for cooperative relation with upper and lower orienting rolls and a fabric seam sensing element, in accordance with the invention.
Figure 5:
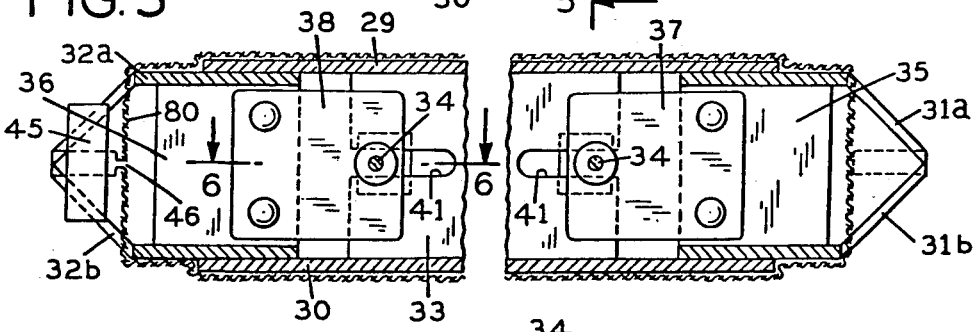
FIG. 5 is a cross sectional view as taken generally on line 5—5 of FIG. 4.
Figure 6:
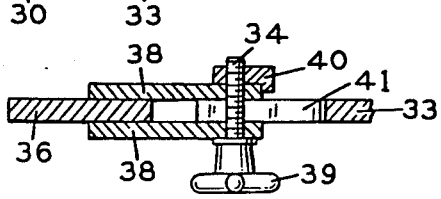
FIG. 6 is an enlarged, fragmentary cross sectional view as taken generally on line 6—6 of FIG. 5.

As reflected in somewhat more detail in FIGS. 4–6, the orienting section 18 of the spreader frame includes upper and lower central plates 29, 30, which are spaced apart a distance substantially greater than the normal relatively narrow thickness of the spreader frame in general. By way of example only, and not of limitation, the thickness of the spreader frame in the orienting section may be on the order of twelve centimeters, whereas elsewhere the thickness may be on the order of two-three centimeters. Thus, fabric initially being recieved over the upstream extremity of the spreader frame is spread to a flat form of a first predetermined width in a relatively thin section of the frame. As the fabric reaches the orienting section 18, it becomes expanded in thickness as it passes over the orienting section and then immediately returns to its more normal thickness on the downstream side of the orienting platform. In order to avoid undue variation in circumferential tension on the fabric during this enlargement and subsequent reduction in thickness, the width of the frame in the area of the platform is correspondingly reduced. This is achieved by means of opposed pairs of side brackets 31, 32, each consisting of upper and lower bracket plates 31*a*, 31*b* and 32*a*, 32*b*, as reflected particularly in FIG. 4. The bracket pairs 31, 32 are arranged to guide the fabric inwardly while increasing the thickness of the fabric tube, such that, in general, there is no significant change in overall circumference of the form provided by the frame.

As reflected in FIG. 5, the platform-forming plates 29, 30 are secured to a transversely disposed spacer plate 33, which is slotted at each end for the slideable reception of a clamping bolt 34. The respective side brackets 31, 32 are rigidly secured in their center areas to spacer plates 35, 36 to which are secured spaced clamping plates 37, 38. The clamping plates are fixed to the spacers 35, 36 and slideably received over the central spacing plate 33. The clamping bolts 34, advantageously provided with hand knobs 39, extend through the clamping plates 37, 38 to a captive nut 40. The bolts 34 are received in elongated, open ended slots 41 in the central spacing plate 33, accommodating a limited amount of inward/outward adjustment of the end brackets 31, 32. Typically, a limited degree of adjustment of the orienting platform is adequate, inasmuch as the finished width of the fabric is determined by downstream portions of the spreader, and not the circumference of the frame at the orienting stage. Indeed, at the orienting stage, it is preferable to have the fabric distended to a width somewhat less than the desired finished width, for example, the natural, relaxed width of the fabric, so that there is little or no circumferential tension on the fabric and it is more easily susceptible of the desired rotational orientation when necessary.

As reflected in FIG. 2, relative width adjustment between the finishing (downstream) section of the spreader frame and the upstream (orienting) section is accommodated by pivot links 41, 42 arranged for limited lateral pivoting movement with respect to the frame sections 31, 32, on the one hand, and frame sections 20, 21, on the other. With this arrangement, the upstream or orienting section of the spreader frame may be preadjusted as appropriate to the incoming width of the fabric, for optimum effectiveness of the orienting operation, while the finishing section 19 may be separately adjusted to the desired finished width of the fabric, typically at a somewhat greater width than desired for orientation. This arrangement is especially advantageous in conjunction with the gas spring type spreader arrangement of the before-mentioned Frezza U.S. Pat. No. 4,192,045, as it permits on-line adjustment of the finish width of the fabric without affecting the orienting stage of the spreader.

Orientation of the incoming fabric is effected by means of upper and lower orienting rolls 43, 44, which overlie respectively the upper and lower orienting plates 29, 30. As the fabric tube passes over the orienting section 18 of the spreader, the location of the sewn seam is detected by a sensor device 45, to be described later herein. If the position of the seam 46 is detected as being below the central plane of the spreader frame (see schematic illustration of FIG. 12) a control circuit is activated to shift the position of the orienting rolls 43, 44 to have a slight angular orientation relative to the longitudinal axis of the spreader, as reflected in FIG. 13. These orienting rolls, which are driven at a speed generally consistent with the rate of advance of the fabric over the spreader, impart a slight rotational component to the fabric tube, such that the position of the seam 46 is readjusted progressively back toward the neutral plane. As this adjustment occurs, the positions of the orienting rollers 43, 44 are progressively adjusted back toward the neutral position, in which the rollers are aligned at right angles to the main axis of the spreader frame. When the seam 46 wanders above the neutral plane, as reflected in the schematic of FIG. 14, then the orienting rollers 43, 44 are adjusted angularly in the opposite direction, as reflected in FIG. 15, imparting a rotational component to the fabric to bring the seam back toward the neutral plane.

Figure 7:
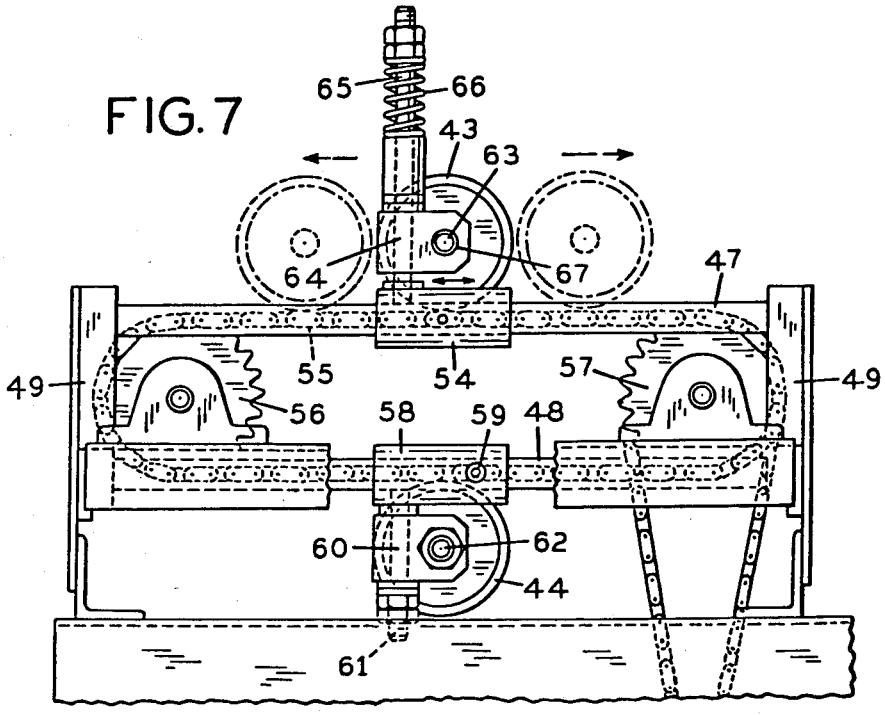
FIG. 7 is a fragmentary side elevational view, as viewed generally at line 7—7 of FIG. 2, illustrating details of the mounting and operation of upper and lower orienting rollers incorporated in the apparatus of the invention.

Mounting of the orienting rollers is accomplished by the mechanisms illustrated in FIGS. 7 and 8, which include, at each side, upper and lower horizontal guide rods 47, 48 carried by structural brackets 49. In the illustrated form of the invention, each of the orienting rolls 43, 44 is both rotationally and slideably supported at one end, and rotationally (but not slideably) mounted at its other end, with the slideable and non-slideable ends being reversed in the case of the upper and lower rollers. With reference to the schematic diagrams of FIGS. 13 and 15, for example, the upper roller 43 is non-slideably journalled at 50, which may be referred to for descriptive purposes as the far side of the equipment, and is slideable longitudinally at the opposite or near side, indicated by the reference numeral 51. Conversely, the lower roller 44 is non-slideably journalled at 52, at the near side, and is movable longitudinally at 53, at the far side of the machine. As reflected in FIG. 7, the upper orienting roll 43 is carried at the near side by means of a slide bearing 54, which is slideably movable on the upper guide rod 47 and is attached to a control chain 55 engaged by an idler sprocket 56 and drive sprocket 57. Through the control means to be later described, the drive sprocket 57, and therefore the chain 55 and bearing block 54 are controllably positioned in response to the detected position of the sewn seam, so that the near end of the upper orienting roller is controllably moved forwardly or rearwardly, toward the positions shown in phantom lines in FIG. 7. The far end of the upper orienting roll is supported by a similar slide bearing (not shown) connected to a chain 55*a* for equal but opposite movement. Such movement imparts an angular orientation to the orienting roll.

The lower orienting roll 44 is supported at the near side, by a bearing block 58, slideably mounted on the lower guide rod 48 and connected to the chain 55. A journal block 60 is pivoted to the bearing block 58, by means of a bolt 61, and the shaft 62 of the orienting roll 44 is non-slideably but rotationally received in the movable journal block in any appropriate manner.

The illustration of FIG. 7 shows the near side mounting of the upper and lower orienting rolls 43, 44. It will be understood that a similar structure is provided at the far side of the machine, except that the upper bearing block, for the roll 43, non-slideably supports the roll at the far side, whereas the lower bearing block 58 at the far side accommodates both rotational and sliding movement. The chains 55 at opposite sides are connected for simultaneous movement, but in opposite directions. Accordingly, when the seam is detected as having wandered below the neutral plane, and clockwise rotation of the fabric tube (as viewed from the front of the apparatus) is indicated, the respective chains 55 are activated to move the respective opposite side bearing blocks for the rolls 43, 44 in opposite directions as refleced in the schematic of FIG. 13. So positioned, both orienting rolls contribute a slight rotational component to the movement of the fabric tube, to correct the positioning of the displaced seam 46. As will be understood the distance between respective pairs of bearing blocks 54, 58 at each end of a given roll will become larger, as the movable bearing blocks are displaced forwardly and rearwardly on their respective guide rods. This is accommodated by providing the roll shafts 62, 63 to have a sliding relationship with one of the journal blocks, as described. As reflected in FIG. 7, for example, the upper, near side journal block 65 is pivotally mounted on its slide block 54, by means of a bolt 65 and compression spring 66. A similar compression spring is used at the far side of the roll 43. The compression springs 66 permit limited vertical displacement of the orienting roll 43, as may be necessary to accommodate a foreign object or the like. The respective springs can also be adjusted (pre-loaded) differently at opposite sides as necessary or appropriate to the operating conditions.

For sensing the position of a sewn seam 46, it is advantageous to incorporate in the seam a fine yarn having a metallic content. Typically, a metallized Mylar or similar yarn may be used for this purpose. Within the theoretical context of this invention, the metallized yarn may be used as a primary medium for sewing of a seam 46. However, inasmuch as the yarn is relatively expensive compared to more conventional threads, it is preferable to sew the seam, structurally, with conventional thread and merely lay in a metallic component more or less in a straight line along the seam.

Figure 9:
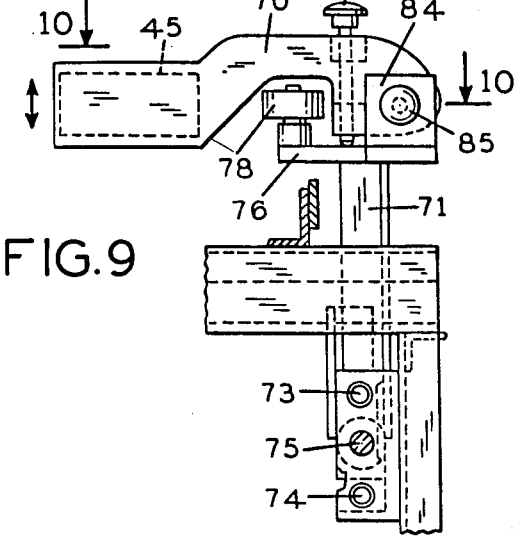
FIGS. 9 and 10 are fragmentary elevation and plan views respectively, partly in section, illustrating details of the mounting of a means for sensing the position of the edge seam in the apparatus of FIG. 1.
Figure 10:
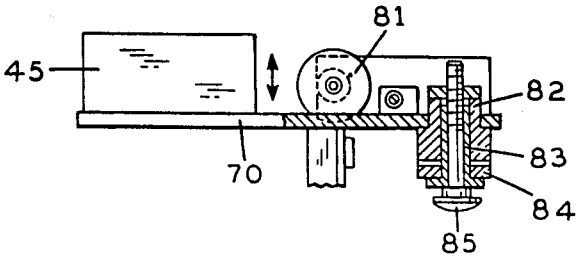

The sensing device 45 preferably employed in the apparatus of the invention is a commercially available unit, known as a "capacitance feeler", made available commercially, as of the filing date hereof, by Erhardt and Leimer, Spartanburg, S.C., under the manufacturer's model No. FKO401. The sensing unit proper is housed in a small box which is mounted upon a pivot arm 70 (see FIGS. 1, 9, 10) mounted on a vertical post 71. The post 71, and a corresponding post 72 at the opposite side of the machine, are mounted for slideable movement toward and away from the center axis of the machine, by means of transverse guide rods 73, 74 and a threaded positioning screw 75, which is threaded in opposite directions at each end and manipulated by a hand wheel 76.

On each of the posts 71, 72 there is mounted a platform 76, 77 carrying a guide wheel 78, 79. When the spreader frame 10 is installed in the processing equipment, the positioning screw 75 is operated to adjust the posts 71, 72 and guide wheels 78, 79 inward until the guide wheels engage the arms 27 of the orienting platform. The orienting section of the frame is thus accurately confined in position, laterally, by the guide wheels 78, 79. Similarly, the orienting section of the frame is confined vertically by the upper and lower orienting rolls 43, 44. Accordingly, with the sensing element 45 mounted on the near side platform 76, adjacent to the guide wheel 78, the geometric relationship of the sensing device 45 and the end brackets **32*a*, 32*b* of the orienting frame is rather accurately maintained. As indicated in FIG. 5, the sensing element is located adjacent a vertically disposed portion 80 of the fabric tube, where the fabric extends between the upper and lower brackets 32*a*, 32*b*, so as to be proximate to the seam 46. Adjustment of the vertical position of the sensing element 45, for initial calibration of the equipment, is accomplished by means of an adjusting screw 81, which bears on the platform 76, adjacent to a hub 82, which is secured to the mounting arm 70 and is pivotally mounted on a bushing 83 carried by a fixed mounting bracket 84. By manipulating the adjusting screw 81, the neural position of the sensor may be precisely located, in order to establish the neutral position of the sewn seam 46 itself at precisely the right level with respect to the spreader frame 10. Likewise, inward-outward adjustment of the sensor is accommodated by a second adjusting screw 85**, to provide an accurate control over the sensitivity of the system.

The sensing element 45 is connected through a control circuit, which in itself is of known and available design, operative to energize a positioning motor 86 (FIG. 11) in response to a sensing of the seam 46 above or below the neutral axis. The types of circuitry and motors suitable for this purpose are readily known and available to those skilled in the art. A particular example thereof is motor No. WN7121-02-07 (80 watt, 350 rpm) as made available as of the filing date hereof by Erhardt and Leimer, Spartanburg, S.C. The electronic circuitry **45*a* (FIG. 11) providing for proportional displacement of the positioning motor 86, as a function of displacement of the seam 46 from the neutral axis, can be electronic module No. EB12031, as made available as of the filing date hereof by Erhardt and Leimer, previously mentioned. Other circuity, motors and sensing elements may, of course, be utilized without departing from the teachings of the invention. However, the foregoing have been found to be satisfactory for the intended purposes as being adequately sensitive and responsive to the positioning of the seam 46. In this respect, it is advantageous to provide for a configuration of the fabric tube in the vicinity of the detecting or sensing element 45, providing for a relatively straight line path of the fabric past the sensing element 45. Accordingly, as the seam 46** becomes displaced upward or downward from its neutral position, it mantains a relatively constant horizontal distance from the sensor, over an extended range of movement, for more accurate and sensitive detection of the seam position and displacement.

As reflected in the schematic of FIG. 11, the positioning motor 86 drives through sprockets 87, 88, a common shaft 89. The shaft 89 drives sprockets 90, 91, at each side. The sprocket 90, directly drives a sprocket 92 associated with the positioning sprockets 56, 57 carrying the positioning chain 55a at the far side of the machine. At the near side, the sprocket 91 drives sprocket 93 through a reversing sprocket 94, so that the positioning sprockets 56, 57 and chain 55 at the near side are driven synchronously but oppositely to their counterparts on the other side of the machine. Thus, any time the sensor 45 detects a vertical displacement of the seam 46, the motor 86 is proportionately activated, to make a compensating positional adjustment of the orienting rolls 43, 44. The magnitude of the adjustment will, of course, be a function of the magnitude of the displacement. Excessive "hunting" of the system, that is, continual overcorrecting and re-overcorrecting, is effectively avoided in the illustrated apparatus by locating the sensing element more or less directly in line with the orienting rolls 43, 44, rather than displaced significantly upstream or downstream therefrom.

Figure 3:
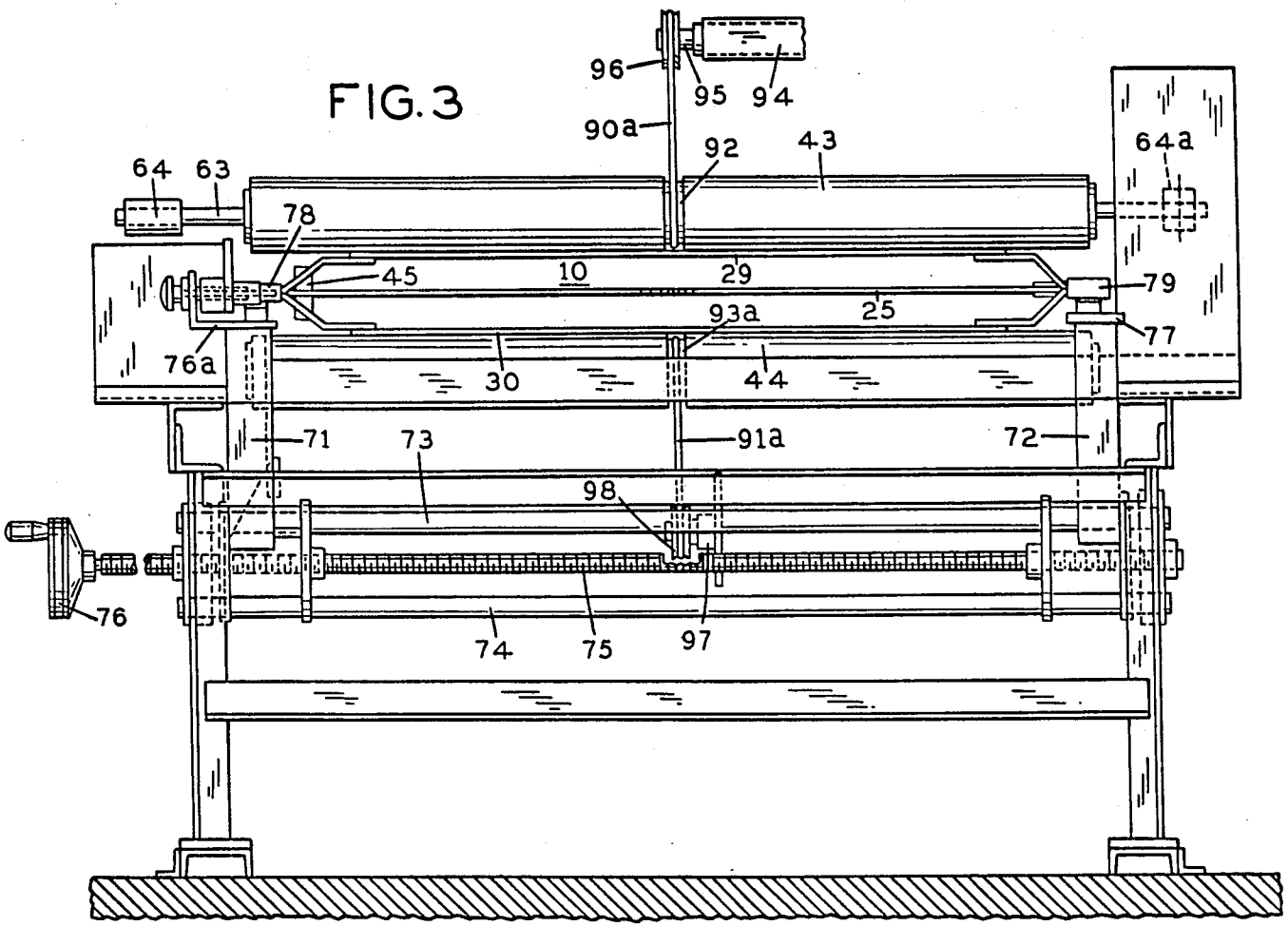
FIG. 3 is a front elevational view of the finishing equipment of FIG. 1, as viewed generally in the direction of line 3—3 of FIG. 2.

To advantage, a simplified yet reliable arrangement for driving of the upper and lower orienting rolls 43, 44 is provided by driving the rolls in their center areas by means of flexible belts 90*a*, 91*a* (FIG. 3). Thus, each of the orienting rolls is provided with a central belt groove 92, 93 for engagement with its respective belt. Extending from the far side of the machine out over the upper orienting roll 43 is a cantilever journal structure 94 carrying a shaft 95 and drive pulley 96, engaging the upper belt 90. A lower journal structure 97 carries a lower drive pulley 98 for engagement with the belt 91*a*. The belts are readily able to accommodate the slight angularity that occurs along the belt as the orienting rolls are adjusted.

Although it is not critical to the invention, it is typical for a single drive motor to be provided for operating the various driven elements of the machine, apart from the positioning adjustment of the orienting rolls, which is accomplished through the positioning motor 86. To this end, a motor 100 is indicated in FIG. 11, which is connected via shaft 110 to the respective edge drive rolls 12, 13. The motor 100 also drives a pair of variable speed pulleys 103, 104 through a common shaft 105, from a series of sprockets 106, 107 and 108, 109 and the drive shaft 110. In the arrangement illustrated, the speed of the motor 100, which may be adjustable, controls directly the speed of the edge drive rolls 12, 13, while the adjustment of the variable pulleys 103, 104 determines the speed of the respective orienting rolls 43, 44 relative thereto. In this respect, the ability to separately vary the speed of the orienting rolls relative to the edge drive rolls provides for a capability of stripe straightening, as well as orienting, during processing of the fabric. In this respect, it is not unusual, in the processing of striped and other knitted fabrics, for the center portion of the stripe or stitch line to tend to lead the portions of the same stripe or stitch line at the edges of the fabric. This tendency can be compensated for by adjustment of the peripheral speed of the orienting rollers 43 relative to the rate at which the fabric is advanced by the edge drive rolls 12, 13.

In the routine operation of the apparatus of the invention in connection with stripe-matched fabric, processed tubular knitted fabric, having been previously subjected to a stripe matching operation and sewn back together along a seam 46 incorporating a metallic thread, is fed over the entry end of the spreader frame 10 and distended to flat form and predetermined width. Desirably, the preliminary width of the fabric, in the upstream portion of the spreader, is less than the ultimate desired spread width of the fabric, (e.g., the natural, relaxed width of the fabric) and remains that way throughout the orienting operation, so that the fabric is not under excessive circumferential tension at the time of rotational orientation. This greatly facilitates the rotational readjustment of the fabric tube, if necessary because of reduced friction against the elements of the spreader frame.

The fabric passes over the entry end of the spreader, and between the guide rollers 79, which accurately locate the spreader frame centrally in the main frame structure of the equipment, and specifically with respect to the sensing element 45. The fabric immediately enters into the orienting section of the spreader frame, in which the fabric is reshaped to have a substantially greater thickness, and is narrowed correspondingly in width to avoid excessive circumferential tension. Thus, the narrowing in width by reason of the geometry of the end brackets 31, 32 substantially compensates for the increasing width of the fabric such that the overall circumferential distance around the frame remains approximately the same. A second of the fabric, approximately 12–13 cm, extends vertically between the bracket arms 32*a*, 32*b*, passing adjacent the front face of the element 45. The sensing element 45 is sensitive to the displacement of the seam 46, above or below neutral, and to the extent of such displacement.

Insofar as the seam 46 is not accurately centered as it passes the sensor 45, the positioning motor 86 will be actuated correspondingly to reposition the orienting rolls 43, 44 from a neutral position shown in FIG. 2, to an angular position as shown in FIG. 15 (if the seam is too low) or FIG. 16 (if the seam is too high). The amount and duration of angular displacement of the orienting rollers will be a function of the magnitude of displacement of the seam 46, as will be understood.

If desired, the orienting rollers 43, 44 may be individually speed controlled relative to the average rate of movement of fabric over the spreader frame (as well as to each other) to bring about an adjustment in the shape of the transverse stripes across the fabric. Thus, if the stripes are bowed in one direction or the other, the orienting rolls may be operated at a slightly slower or faster speed than the average rate of fabric movement, so as to advance or retard the center portion of the stripe relative to the edge extremities, the top relative to the bottom, etc.

After passing the orienting rolls, the fabric exits from the end brackets 31, 32, returning to its customary minimum thickness and simultaneously returning to its initial width. The fabric then advances over transition links 41, 42, and on to brackets 20, 21 of the finishing section of the spreader. In the finishing section, the fabric is spread to a greater width, as desired for the processing operation, which may be considerably wider than the initial spread width of the fabric and may place the fabric under considerable circumferential tension. It will be understood, in this respect, that the width of the processing frame section 19 may be adjusted independently of the width of the orienting section 18, and that the width of each may be adjusted for optimum results in the particular operation performed thereon.

Once the fabric is on the processing section, the operations are entirely conventional. The fabric may, if desired, be overfed onto the downstream section of the spreader frame (i.e. on the downstream side of the edge drive rolls) to induce lengthwise relaxation. Spread and (typically) relaxed fabric is then passed through a steaming box 14 and then discharged from the spreader into the nip of calendering rolls 15, 16. The calendered fabric is then gathered by means (not shown) in roll or folded form.

As will be readily appreciated, the attainments of edge seam alignment as heretofore practiced, with an operator stationed at the entry end of the machine manually aligning the fabric as it approached and entered onto the upstream end of the spreader, has been necessarily highly demanding of operator attention and, as a consequence, typically not likely to achieve a high level of perfection in the finished product. With the system of the present invention, an approximate alignment of the seam 46 in the general region of the edge of the spreader may be accomplished with minimum operator attention and skill. Thereafter, a precision reorientation of the fabric may be accomplished by means of the adjustable positioned orienting rollers 43, 44 as previously described.

Although the equipment of the invention is most effective when utilized with the automatic sensing and positioning controls, it is also possible to realize some of the advantages in a purely manually controlled arrangement, utilizing manual devices, such as a manual switch (not shown) for controlling the motor 86 and positioning the respective orienting rollers 43, 44. Thus, with only a manual means of control, an operator, observing an unwanted displacement of the seam 46, may adjust the position of the orienting rollers 43, 44 in a compensating direction and attend to other tasks while the orienting rolls begin to effect a rotational reorientation of the fabric toward the neutral displacement position. This manual mode, while not as effective as the automatic mode, is far superior to the conventional manual methods heretofore practiced, in which the operator's hands are the only medium by which rotational reorientation of the fabric is effected.

It should be understood, of course, that the specific form of the invention herein illustrated and described is intended to be representative only, as certain changes may be made therein without departing from the clear teachings of the disclosure. For example, while the apparatus specifically illustrated is primarily intended for use in the finishing of tubular knitted fabric, the orienting equipment is equally useful in other processing operations, such as padding. Accordingly, reference should be made to the following appended claims in determining the full scope of the invention.

We claim:

1. Apparatus for processing tubular knitted fabric having a longitudinally extending edge demarcation, which comprises (a) a first spreader frame section having an entry end and a discharge end, (b) an orienting roller externally engageable with fabric on said first spreader frame section, (c) means for controllably driving said orienting roller, (d) means for adjustably angularly positioning said orienting roller relative to the longitudinal axis of said first spreader frame section, whereby to impart a rotational component of movement to tubular knitted fabric passing over said first spreader frame section, for orienting said edge demarcation at or near the edge extremity of the fabric on said spreader frame section, and (e) a second spreader frame section immediately downstream of said first spreader frame section for receiving and further laterally distending said fabric.

2. Apparatus according to claim 1, further characterized by (a) means for sensing the displacement of said edge demarcation from a predetermined position, and (b) means responsive to the sensing means for controlling the angular position of said orienting roller as a function of displacement of said edge demarcation.

3. Apparatus according to claim 2, further characterized by (a) said edge demarcation comprising a sewn seam, (b) said seam including a metallic thread component, and (c) said sensor comprising a capacitance device operative to sense the position of said metallic thread component.

4. Apparatus according to claim 1, further characterized by (a) an orienting platform, including a wide flat plate forming part of said spreader frame and extending transversely internally of the tube of fabric, (b) said orienting roller being mounted in opposing relation to said plate for pivoting movement with respect to the longitudinal axis of the fabric tube, (c) said roller being so cooperatively related to said plate as to be in contacting engagement with fabric passing over said plate, in any operative position of said roller.

5. Apparatus according to claim 1, further characterized by (a) said first and second spreader frame sections comprising orienting and finishing sections, (b) independent lateral width adjustment means for each of said frame sections, and (c) transition links pivotally connecting said orienting and finishing frame sections and accommodating independent lateral adjustment of each.

6. Apparatus according to claim 5, further characterized by (a) guide roll means engaging the opposite sides of said frame in the area of the orienting section for confining and positioning said section, and (b) laterally adjustable edge drive roll means engaging the finishing section of said spreader frame.

7. Apparatus for rotationally orienting tubular knitted fabric during processing thereof, which comprises (a) a spreader frame assembly for spreading said fabric to flat form and predetermined width, (b) said tubular fabric having opposed primary sides and connecting edge areas, (c) said spreader frame assembly having an orienting section of increased thickness and correspondingly narrower width, (d) said orienting section defining a relatively flat, straight edge area of fabric extending from one primary side to the other, (e) control means for scanning said edge area to determine rotational orientation of the fabric tube, and (f) at least one orienting roller engaging said fabric in the region of said orienting section, and (g) positioning means for controllably positioning said orienting roller to impart a controlled rotational component to the fabric tube, (h) said apparatus including a fabric finishing section including steamer and calender rolls, (i) said spreader frame assembly including a finishing section extending through said steamer and substantially to said calender rolls, and (j) the finishing section of said spreader having a greater circumference and greater width than said orienting section.

8. Apparatus according to claim 7, further characterized by (a) sensing means mounted adjacent the orienting section of said spreader frame, in position to scan said flat edge area, (b) said positioning means co-acting with said sensing means for continuously adjusting the angular position of said orienting roller to compensate for rotational displacement of said tubular fabric.

9. Apparatus according to claim 8, particularly for use in connection with stripe matched fabric having a longitudinal sewn seam and in which said seam includes a metallic thread, further characterized by (a) said sensing means comprising a capacitance device operative to sense the position and displacement of said metallic thread.

10. Apparatus according to claim 7, further characterized by (a) the orienting and finishing sections of said spreader frame being independently adjustable, and (b) pivoted transition links joining said frame sections at each side thereof.

11. Apparatus according to claim 10, further characterized by (a) gas spring separating means connecting opposite sides of the finishing section of said spreader frame, and (b) width-adjustable edge drive rolls positioning and confining the opposite sides of said spreader frame.

12. Apparatus according to claim 7, further characterized by (a) said apparatus including upper and lower orienting rolls positioned, respectively, above and below the orienting section of said spreader frame, (b) said positioning means being operative to simultaneously angularly re-position said rollers.

13. Apparatus according to claim 12, further characterized by (a) one of said orienting rollers being mounted for pivoting action about a vertical disposed axis located approximately midway between the ends of said rollers.

* * * * *